US006843692B2

(12) United States Patent
Matsuda

(10) Patent No.: US 6,843,692 B2
(45) Date of Patent: Jan. 18, 2005

(54) PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/770,701

(22) Filed: Feb. 2, 2004

(65) Prior Publication Data

US 2004/0180589 A1 Sep. 16, 2004

(30) Foreign Application Priority Data

Feb. 4, 2003 (JP) ..... 2003-026836

(51) Int. Cl.[7] ..... B63H 21/10
(52) U.S. Cl. ..... 440/88 C; 440/88 D
(58) Field of Search ..... 440/88 C, 88 D, 440/88 M, 88 N

(56) References Cited

U.S. PATENT DOCUMENTS 5,957,072 A * 9/1999 Hattori ..... 114/55.57
5,967,868 A * 10/1999 Ito et al. ..... 440/111
6,038,992 A * 3/2000 Smith ..... 114/183 R

FOREIGN PATENT DOCUMENTS

JP 2002-357125 12/2002

* cited by examiner

*Primary Examiner*—Stephen Avila
(74) *Attorney, Agent, or Firm*—Kolisch Hartwell, P.C.

(57) ABSTRACT

A personal watercraft including an engine mounted within a body defined by a hull and a deck covering the hull from above is disclosed, the watercraft being configured to cool at least part of the engine and an auxiliary device using water outside the watercraft, the watercraft including a cooling water passage provided in the part of the engine and the auxiliary device, the water outside the watercraft being supplied to the cooling water passage, a coupling member forming a part of a liquid connecting coupler and provided to fluidically communicate with the cooling water passage, the coupling member having a connecting portion to which another coupling member forming another part of the liquid connecting coupler is removably attachable, the coupling member being fixed such that the connecting portion is exposed outside the body, and a lid member configured to open and close the connecting portion of the coupling member.

9 Claims, 10 Drawing Sheets

PERSONAL WATERCRAFT

BACKGROUND OF THE INVENTION

1. Field of the Invention

The present invention relates to a personal watercraft (PWC) which ejects water rearward and planes on a water surface as the resulting reaction. More particularly, the present invention relates to a personal watercraft capable of easily cleaning a cooling water passage of at least a part of an engine or auxiliary device mounted therein.

2. Description of the Related Art

In recent years, so-called jet-propulsion personal watercraft have been widely used in leisure, sport, rescue activities, and the like. The personal watercraft is configured to have a water jet pump that pressurizes and accelerates water sucked from a water intake generally provided on a bottom surface of a hull and ejects it rearward from an outlet port. Thereby, the personal watercraft is propelled. In the jet-propulsion personal watercraft, a steering nozzle provided behind the outlet port of the water jet pump is swung either to the right or to the left, to change the ejection direction of the water to the right or to the left, thereby turning the watercraft to the right or to the left.

In the personal watercraft, an engine configured to drive the water jet pump is mounted within a relatively narrow engine room defined by the hull and a deck covering the hull from above. The personal watercraft typically has a water-cooling system configured to draw water from outside the watercraft through the water jet pump and supply the water to cooling water passages of the engine, and an auxiliary device for use as cooling water to cool these devices (see Japanese Laid-Open Patent Application No. 2002-357125). Such a cooling system is simple and has high cooling capability.

When the personal watercraft is used on sea, sea (salt) water is used to cool the engine and the auxiliary device. After the watercraft is beached, the cooling water passages or the like of the engine and the auxiliary device must be cleaned using fresh water.

In the conventional cleaning system, the cooling water passages or the like are typically cleaned in such a manner that a plug covering a water inlet, which is provided at an upper end portion of the engine, is removed, and a tip end of a hose is inserted into the water inlet by an operator to allow the fresh water to be supplied to the cooling water passages through the water inlet.

In the personal watercraft constructed as described above, the operator must hold the hose while cleaning the cooling water passages. In order to expose the engine to allow the fresh water to be supplied, a straddle-type seat provided over the engine must be removed.

During cleaning, the engine must be running to allow the cooling water passage within the engine or the auxiliary device to be sufficiently cleaned using fresh water (cleaning water). If the engine is running with the seat removed, then a loud noise is emitted from the engine.

SUMMARY OF THE INVENTION

The present invention addresses the above described condition, and an object of the present invention is to provide a personal watercraft capable of easily cleaning a cooling water passage of an engine or auxiliary device while reducing a level of noise emitted from the engine, after the watercraft is beached.

According to the present invention, there is provided a personal watercraft including an engine mounted within a body defined by a hull and a deck covering the hull from above, the watercraft being configured to cool at least part of the engine and an auxiliary device using water outside the watercraft, comprising a cooling water passage provided in the part of the engine and the auxiliary device, water from outside the watercraft being supplied to the cooling water passage, a coupling member forming a part of a liquid connecting coupler and provided to fluidically communicate with the cooling water passage, the coupling member having a connecting portion to which another coupling member forming another part of the liquid connecting coupler is removably attachable, the coupling member being fixed such that the connecting portion is exposed outside the body, and a lid member configured to open and close the connecting portion of the coupling member.

In the personal watercraft constructed as described above, after the personal watercraft is beached, the coupling member and the other coupling member are connected to be formed into the liquid connecting coupler, by removing the lid member from the connecting portion of the coupling member and attaching the other coupling member connected to a tip end of the hose connected at a base end to a water line to the coupling member. After the connection, cooling water passages of the engine and the auxiliary device can be easily cleaned using fresh water running through the hose and the liquid connecting coupler merely by opening a plug of the water line. The cleaning is carried out without a need for a person to hold the hose with his or her hand. When using a commercially available coupler used in gardening as the liquid connecting coupler, cleaning is carried out in a garage at home as well as a storage yard of the watercraft merely by connecting the other coupling member at the tip end of the hose which is used for gardening to the coupling member of the personal watercraft. Also, by providing the coupling member at a position on the deck or the hull other than the seat that closes the opening above the engine, cleaning is carried out under the condition in which the engine is running with the engine room closed and, therefore, cleaning is carried out with less noise.

The coupling member may be connected to one of a coupling member of a pair of coupling members of the liquid connecting coupler for gardening. Alternatively, as the coupling member, a coupling member made of a heat-resistant and durable material different from that of the commercially available coupling member may be used.

The cooling water passage may be fluidically connected to the coupling member through a tube. Thereby, flexibility in piping is increased and the coupling member can be easily provided at any location.

The tube may be a water inspection tube used to detect the cooling water of the engine and the lid member may be provided with a water inspection port through which the cooling water is discharged outside.

The connecting portion may have an opening directed outside and fluidically communicate with the cooling water passage, and the lid member may be configured to openably close the connecting portion of the coupling member by screwing a male screw formed on an outer peripheral face of the lid member to a female screw formed on an inner peripheral face of the connecting portion. Cleaning is easily carried out by rotating the lid member to cause it to disengage from and release from the coupling member and by connecting the other coupling member to the connecting member or, otherwise, the connecting portion is closed by the lid member to inhibit the cooling water of the engine and the auxiliary device from being discharged through the connecting portion.

An outer peripheral edge of a flange portion of the lid member may be configured to protrude radially outward relative to an outer peripheral edge of an opening end portion of the coupling member, and the protruding outer peripheral edge has convex and concave faces to provide a non-slip surface. Thereby, the lid member can be rotated to be loosened or fastened easily by a hand of an operator.

The coupling member may be provided so as to be covered by an openable cover. By opening the cover with the engine room closed, the engine can be cleaned with a lower level of noise.

The lid member may be provided with a water inspection port through which the cooling water is discharged outside. Such a lid member can be used both for water inspection during cruising and for cleaning by removing the lid member.

The water inspection port may be provided forward of a seat straddled by a rider, or a standing deck on the watercraft. This is because a water inspection port with such a location is easily checked visually by the rider.

The coupling member includes an insertion part having a flange portion at an end portion thereof and an insertion portion extending from the flange portion and connected to the tube, and a cylindrical base part having a bottom portion, the base part including a penetrating hole formed at a center portion of the bottom portion thereof, through which the insertion portion is inserted, the bottom portion provided in an outer peripheral region of the penetrating hole being engageable with the flange portion such that the flange portion of the insertion part and the bottom portion of the cylindrical base part are rotatable relative to each other, the flange portion and the bottom portion being arranged in a longitudinal direction of the coupling member, and a female screw formed on an inner peripheral face of the cylindrical base part.

The above and further objects and features of the invention will more fully be apparent from the following detailed description with accompanying drawings.

DETAILED DESCRIPTION OF THE PREFERRED EMBODIMENTS

Hereinafter, embodiments of a personal watercraft of the present invention will be described with reference to the accompanying drawings.

Figure 1:
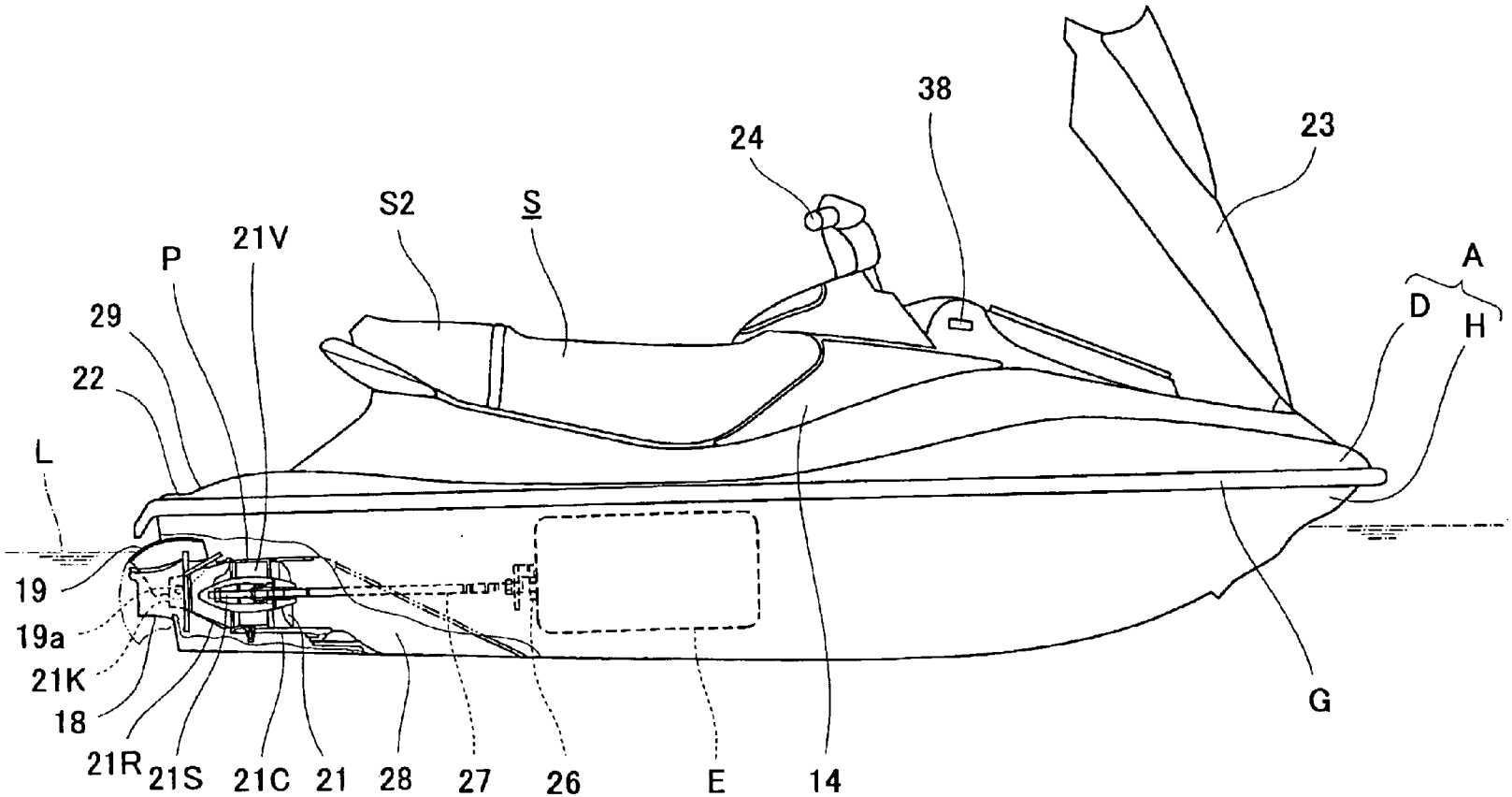
FIG. 1 is a side view of a personal watercraft according to an embodiment of the present invention, with a rear portion thereof being partially cut away to show a water jet pump.
Figure 2:
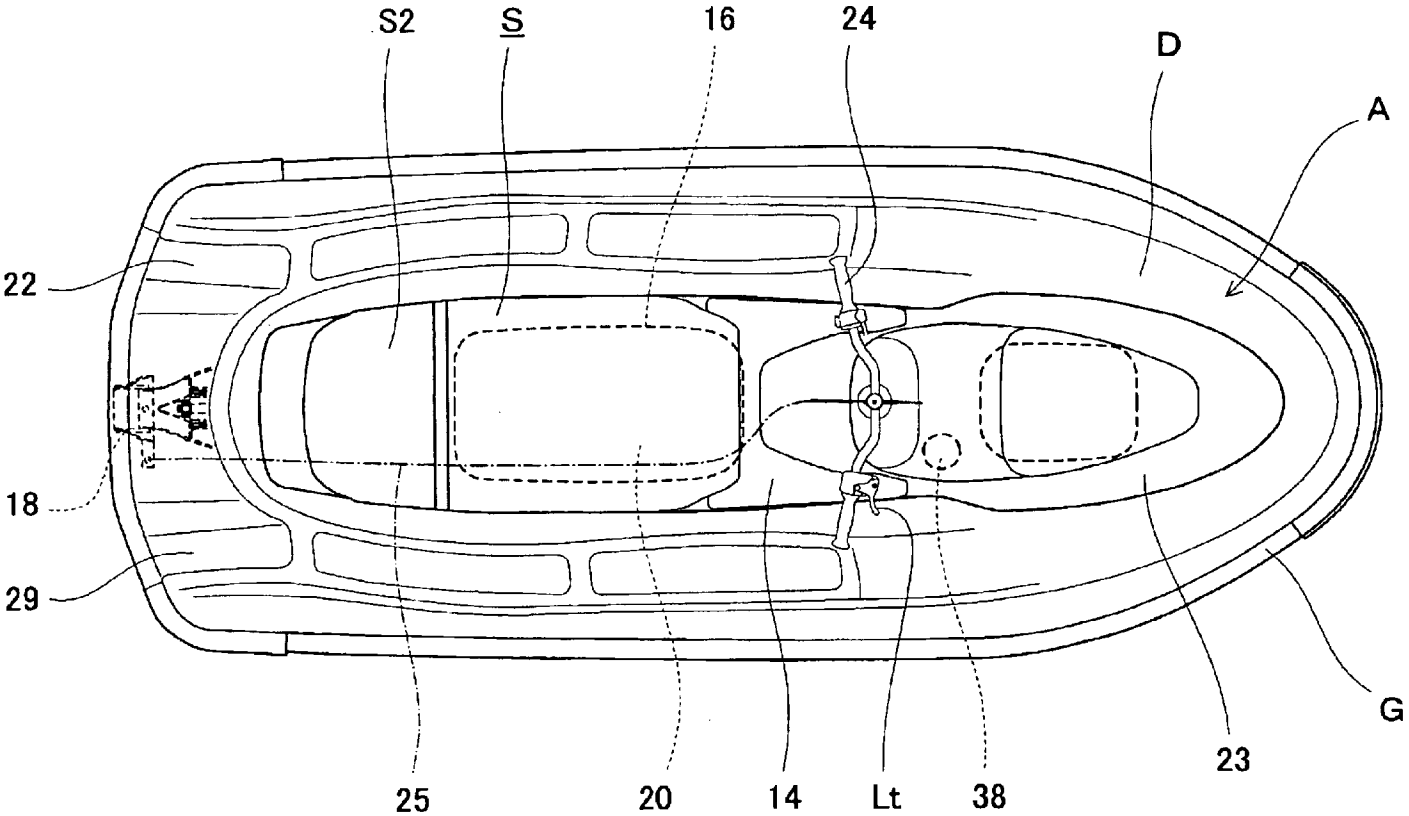
FIG. 2 is a plan view of the personal watercraft in FIG. 1.

In FIGS. 1 and 2, A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft in a certain condition, for example, watercraft being at rest on the water.

As shown in FIG. 2, an opening 16, which has a substantially rectangular shape seen from above, is formed at a relatively rear section of the deck D such that it extends in the longitudinal direction of the body A. As shown in FIGS. 1 and 2, a riding seat S is provided over the opening 16.

An engine E (see FIG. 1) is provided in a chamber (engine room) 20 defined by the hull H and the deck D below the seat S and having a convex transverse cross-section.

The engine E is a multiple-cylinder (e.g., four cylinders) four-cycle water-cooled engine. As shown in FIG. 1, a crankshaft 26 of the engine E is mounted along the longitudinal direction of the body A. An output end of the crankshaft 26 is rotatably coupled integrally with a pump shaft 21S of a water jet pump P through a propeller shaft 27. An impeller 21 is attached on the pump shaft 21S of the water jet pump P. The impeller 21 is covered with a pump casing 21C on the outer periphery thereof. A water intake 17 is provided on the bottom of the hull H. The water is sucked from the water intake 17 and fed to the water jet pump P through a water intake passage 28. The water jet pump P pressurizes and accelerates the water by rotation of the impeller 21. The pressurized and accelerated water is discharged through a pump nozzle 21R having a cross-sectional area of flow gradually reduced rearward, and from an outlet port 21K provided on the rear end of the pump nozzle 21R, thereby obtaining the propulsion force.

In FIG. 1, 21V denotes fairing vanes for guiding water flow behind the impeller 21. As shown in FIGS. 1 and 2, reference numeral 24 denotes a bar-type steering handle. The handle 24 operates in association with a steering nozzle 18 swingable to the right or to the left behind the pump nozzle 21R. When the rider rotates the handle 24 clockwise or counterclockwise, the steering nozzle 18 is swung toward the opposite direction so that the watercraft can be correspondingly turned to any desired direction while the water jet pump P is generating the propulsion force. As shown in FIG. 2, the handle 24 is provided with a throttle lever Lt for controlling an engine speed of the engine E.

As shown in FIG. 1, a bowl-shaped reverse deflector 19 is provided above the rear side of the steering nozzle 18 such that it can swing downward around a horizontally mounted swinging shaft 19*a*. The deflector 19 is swung downward to a lower position behind the steering nozzle 18 to deflect the ejected water from the steering nozzle 18 forward and, as the resulting reaction, the personal watercraft moves rearward.

In FIGS. 1 and 2, reference numeral 22 denotes a rear deck. The rear deck 22 is provided with an openable rear hatch cover 29. A rear compartment with a small capacity is provided under the rear hatch cover 29. In FIG. 1 or 2, reference numeral 23 denotes a front hatch cover. A front compartment 15 is provided under the front hatch cover 23 to store equipments and the like.

The four-cylinder water-cooled engine of the personal watercraft constructed as described above is configured to draw water outside the watercraft to cooling water passages of the engine E and an auxiliary device through the water intake 17 for use as cooling water to cool the engine E and the auxiliary device (oil tank, muffler, etc) and to thereafter discharge the water outside the watercraft. As used herein, the cooling passages include water jackets within which the cooling water flows. When the personal watercraft is used on sea, sea (salt) water is supplied to the engine E and the auxiliary device as the cooling water.

Figure 4:
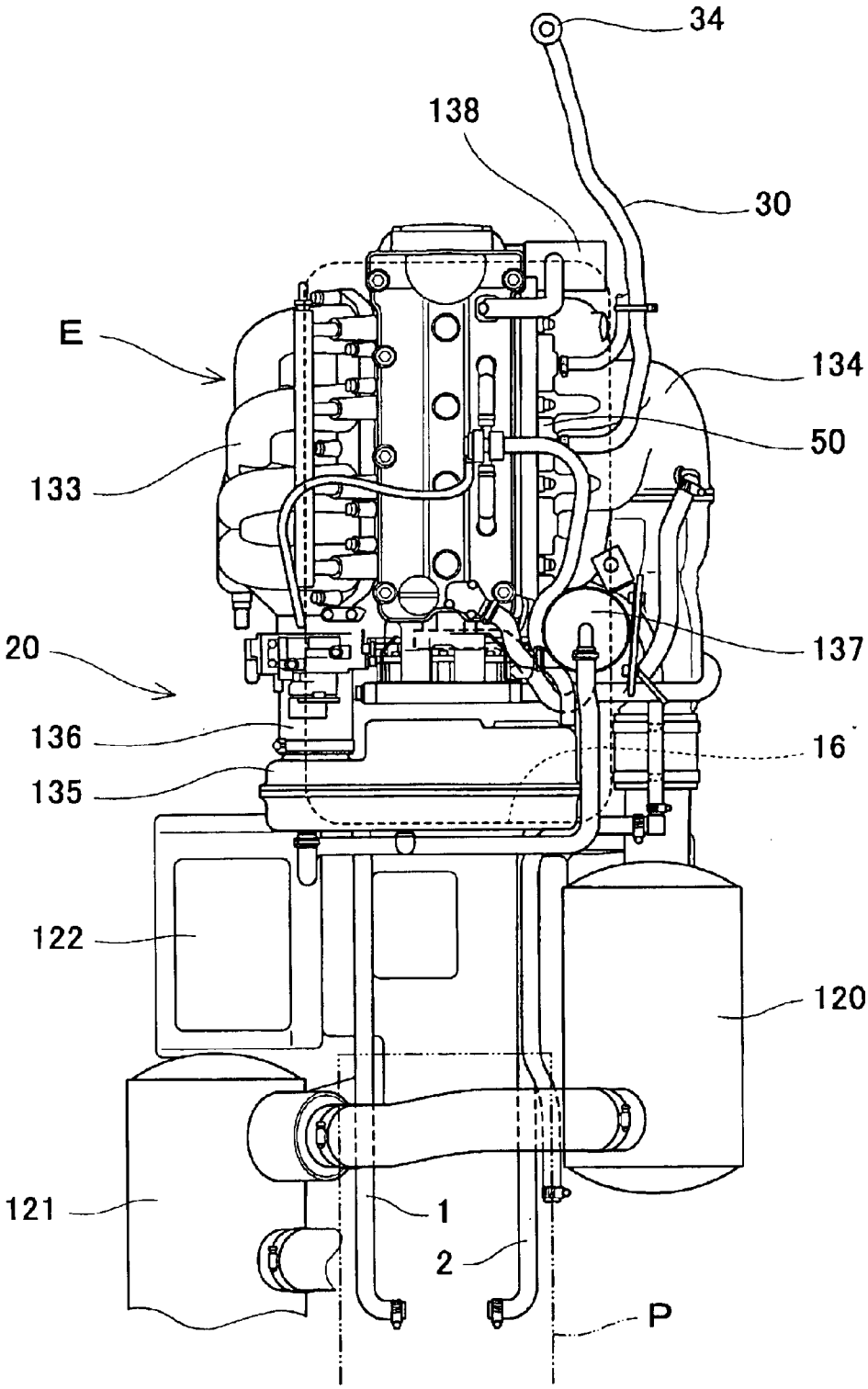
FIG. 4 is a plan view showing a cleaning tube within an engine room of the personal watercraft in FIG. 1 and placement of a first coupling member of the liquid connecting coupler provided at the tip end of the tube.

The cooling water is supplied from the water jet pump P to the cooling water passage of the engine E through a cooling water supply pipe 1 in FIG. 4 and to the cooling water passage of the auxiliary device through a cooling water supply pipe 2 in FIG. 4. Specifically, upstream ends of the pipes 1 and 2 in a flow passage of the cooling water are connected to a positive-pressure region within the water-jet pump P (see FIG. 1) to allow the cooling water pressurized by the water jet pump P to be supplied to the engine E and the auxiliary device.

The personal watercraft is equipped with a cleaning system to clean the cooling water passages. As shown in FIG. 4, a base end of a tube 30 is connected to the cooling water passage of the engine E disposed in the engine room 20, for example, a water jacket of a cylinder head 50.

Figure 5A:
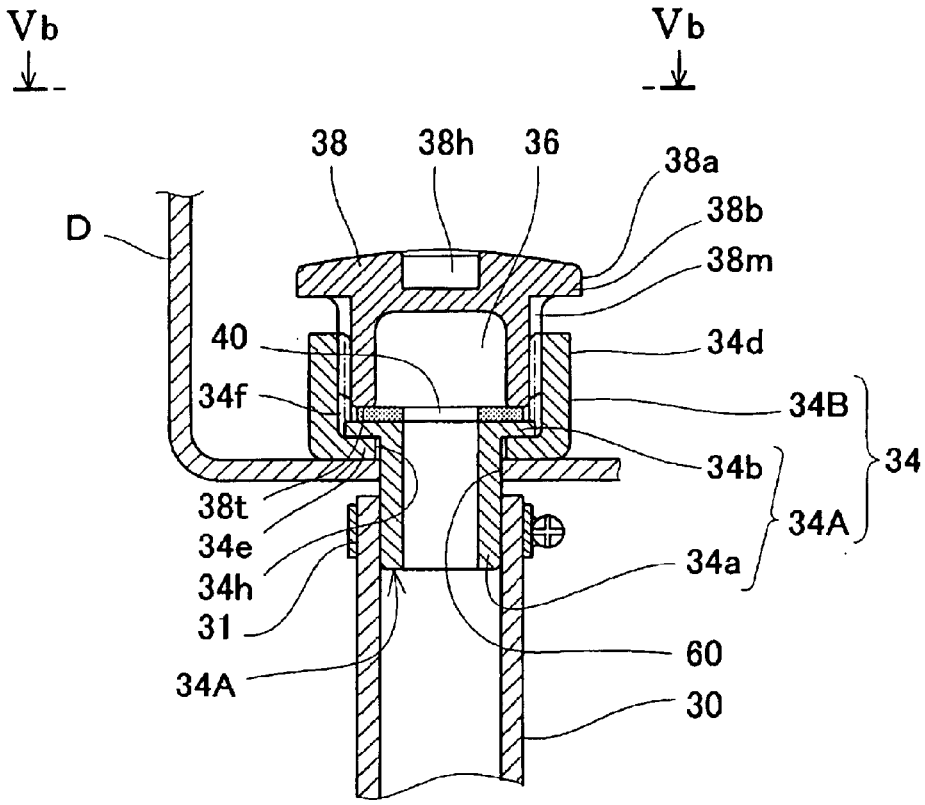
FIG. 5A is a partially enlarged cross-sectional view showing the first coupling member in FIG. 4 mounted to a deck.
Figure 5B:
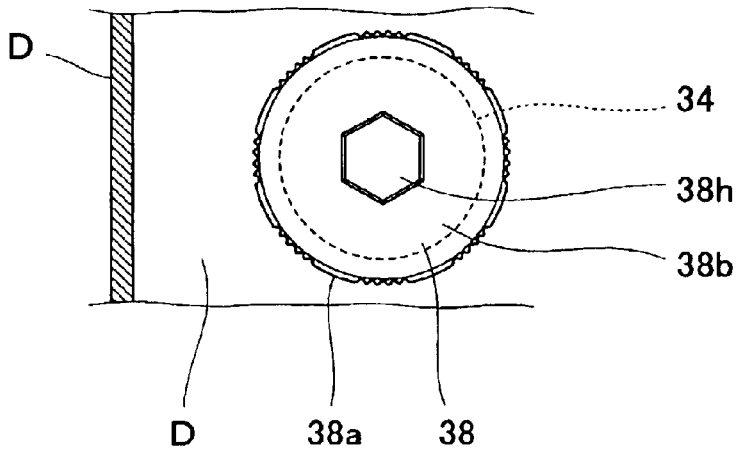
FIG. 5B is a view taken in the direction of arrows along line Vb—Vb in FIG. 5A, showing the first coupling member in FIG. 4 mounted to the deck.

A first coupling member 34 forming a coupling member of a liquid connecting coupler 32 (see FIG. 7) is attached to a tip end of the tube 30. As shown in FIG. 5A, the first coupling member 34 is mounted to an outer surface of the deck D such that an opening 36 thereof is directed outward. As shown in FIG. 5A, the first coupling member 34 includes an insertion part 34A comprised of a large-diameter flange portion 34*b* at an end thereof on the side where the first coupling member 34 is connected to a second coupling member 35 of the liquid connecting coupler 32 (upper end in FIG. 5) and a pipe-shaped insertion portion 34*a* extending downward from the flange portion 34*b* on the side where the first coupling member 34 is connected to the tube 30.

A lower end portion of the insertion portion 34*a* extends through a penetrating hole 60 formed in the deck D, and the tube 30 is connected to the lower end portion of the insertion portion 34*a*. The insertion portion 34*a* is firmly fixed to the tube 30 by means of a belt-type fixing member 31 provided on an outer peripheral side of the tube 30.

The first coupling member 34 further includes a cylindrical base part 34B having a bottom portion 34*e* formed below the opening 36. The base part 34B is structured such that an inner diameter of a cylindrical portion 34*d* (a diameter of the opening 36) is slightly larger than an outer diameter of the flange portion 34*b* to allow the flange portion 34*b* to be smoothly inserted into the opening of the cylindrical base part 34B. And, a penetrating hole 34*h* is formed at the center of the bottom portion 34*e* of the base part 34B. The diameter of the penetrating hole 34*h* is substantially equal to or slightly larger than the outer diameter of the insertion portion 34*a*. A female screw 34*f* is formed on an inner peripheral face of the cylindrical portion 34*d* (on the outer periphery of the opening 36). The first coupling member 34 is, as shown in FIG. 5A, mounted in such a manner that the bottom portion 34*e* of the cylindrical base part 34B is mounted on the deck to be retained between the outer surface of the deck D and the flange portion 34*b* of the insertion part 34A and then the insertion part 34A is fixed rigidly to the deck D such that the cylindrical base part 34B is rotatable relative to the insertion part 34A.

As shown in FIG. 5A, a lid member 38 is screwed to the opening 36 formed on the cylindrical base part 34B of the first coupling member 34 so as to open and close the opening 36. That is, a male screw 38*m* formed at a lower end portion of the lid member 38 is screwed to the female screw 34*f*. A flange portion 38*b* is formed on an upper end side of the male screw 38*m*. An outer peripheral face 38*a* of the flange portion 38*b* is formed by concave and convex face for non-slip. A hexagon socket 38*h* is formed at the center of an upper surface of the flange portion 38*b* to allow the lid member 38 to be rotated by a hexagon wrench.

A lower end face 38*t* of the lid member 38 is ring-shaped. With the lid member 38 screwed to the base part 34B of the first coupling member 34, the lower end face 38*t* of the lid member 38 presses against a packing 40 made of a flexible material (e.g., rubber), thus enabling sealing between the lower end face 38*t* of the lid member 38 and the upper end face of the flange portion 34*b*.

The first coupling member 34 is directly attached to the deck D in this embodiment. Alternatively, the first coupling member 34 may be mounted to the deck D or the hull H by means of a bracket.

Figure 6:
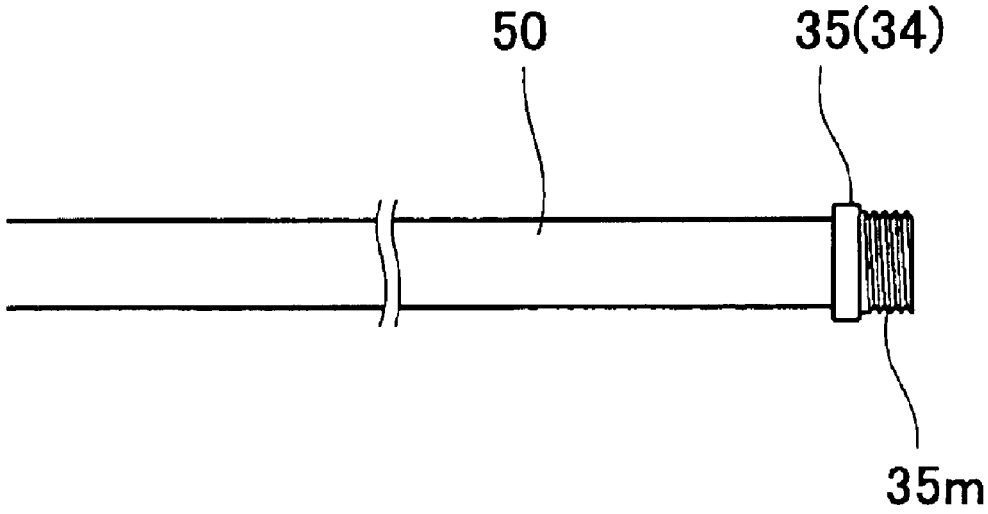
FIG. 6 is a view showing a tip end portion of a hose with a second coupling member attached, the second coupling member being connected to the first coupling member.

The first coupling member 34 is connected to a second coupling member 35 in FIG. 6 attached to an end of a hose 50. The first and second coupling members 34 and 35 are available as a gardening tool in the United States. Using the hose 50, the cooling passages of the engine E and the auxiliary device can be cleaned easily.

Figure 7:
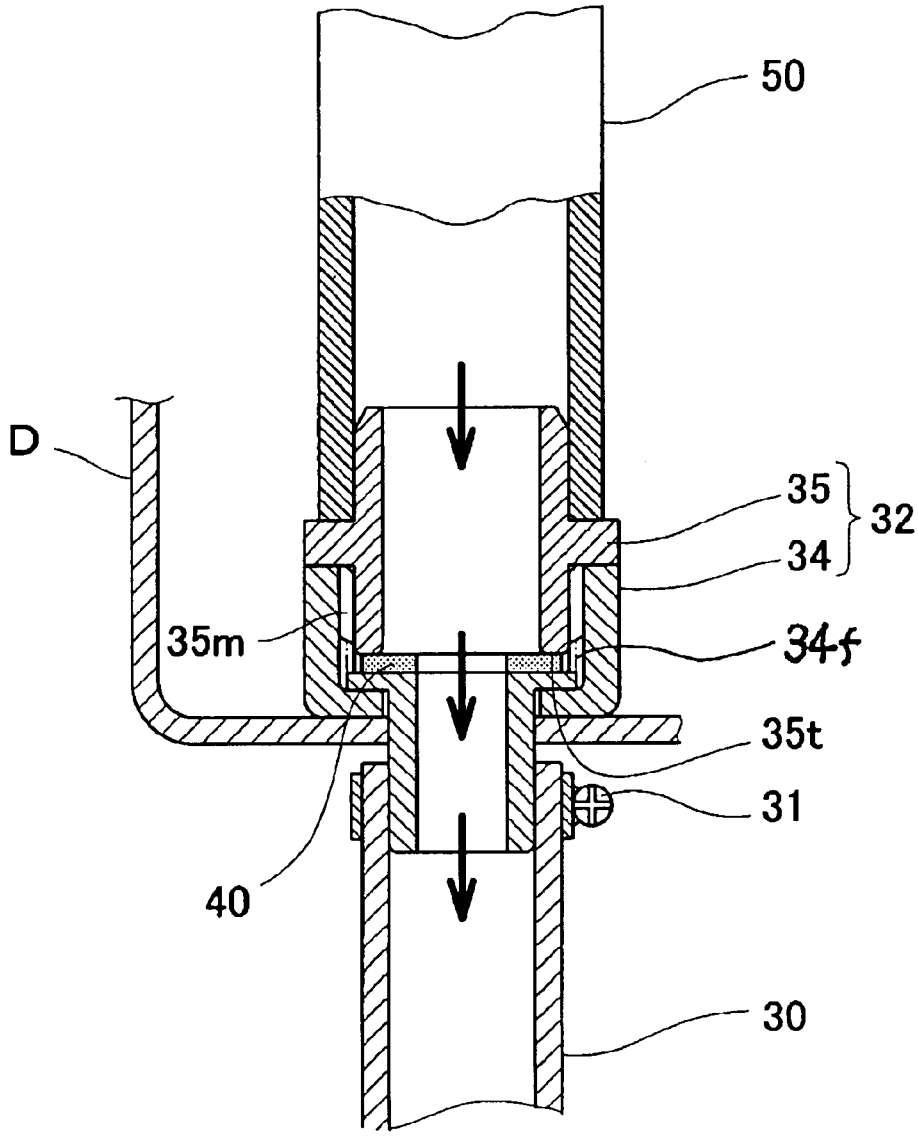
FIG. 7 is a cross-sectional view showing a structure in which the second coupling member in FIG. 6 is connected to the first coupling member in FIGS. 5A and 5B.

As shown in FIG. 7, a male screw 35*m* is formed at a lower end portion of the second coupling member 35. The male screw 35*m* is identical to the male screw 38*m* of the lid member 38. The tube 30 inside the body A of the watercraft is easily connected to the hose 50 outside the body A by removing the lid member 38 and then screwing the male screw 35*m* of the second coupling member 35 to the female screw 34*f* of the first coupling member 34. A lower end face 35*t* of the second coupling member 35 is ring-shaped as in the lower end face 38*t* of the lid member 38 and, therefore, presses against the packing 40, thus enabling sealing between the lower end face 35*t* of the second coupling member 35 and the first coupling member 34.

When the personal watercraft is beached, the cooling passages of the engine E and the auxiliary device can be easily cleaned by removing the lid member 38 and by connecting the second coupling member 35 to the first coupling member 34 attached to the body A. Thus, the cooling passages can be cleaned without a need for the operator to hold the hose 50 or the like. Since the first coupling member 34 is provided at a position of the deck D or the hull H other than the seat S that closes the opening 16 of the body A above the engine E, cleaning can be carried out with the engine room 20 substantially closed. As a result, a lower level of noise is emitted from the engine E during cleaning.

The first and second coupling members 34 and 35 constituting the liquid connecting coupler 32 are widely available as a gardening tool in the United States. In other words, the cooling water passages of the engine and the auxiliary device can be easily cleaned, regardless of location.

Figure 8:
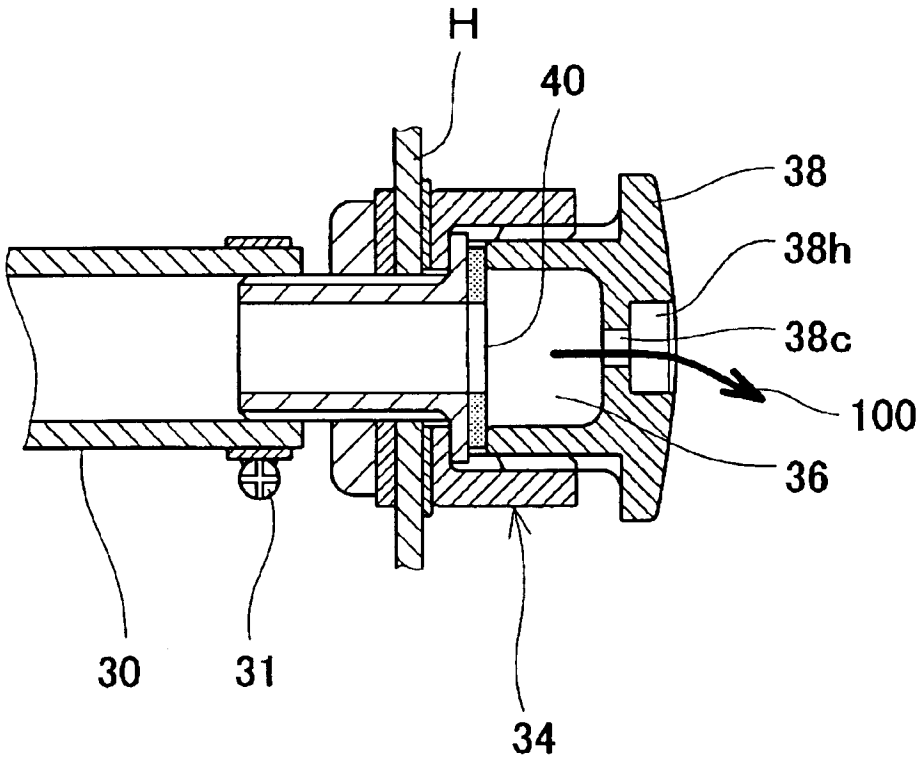
FIG. 8 is a partially enlarged cross-sectional view showing another structure of the first coupling member of the liquid connecting coupler which is mounted to a hull.
Figure 9:
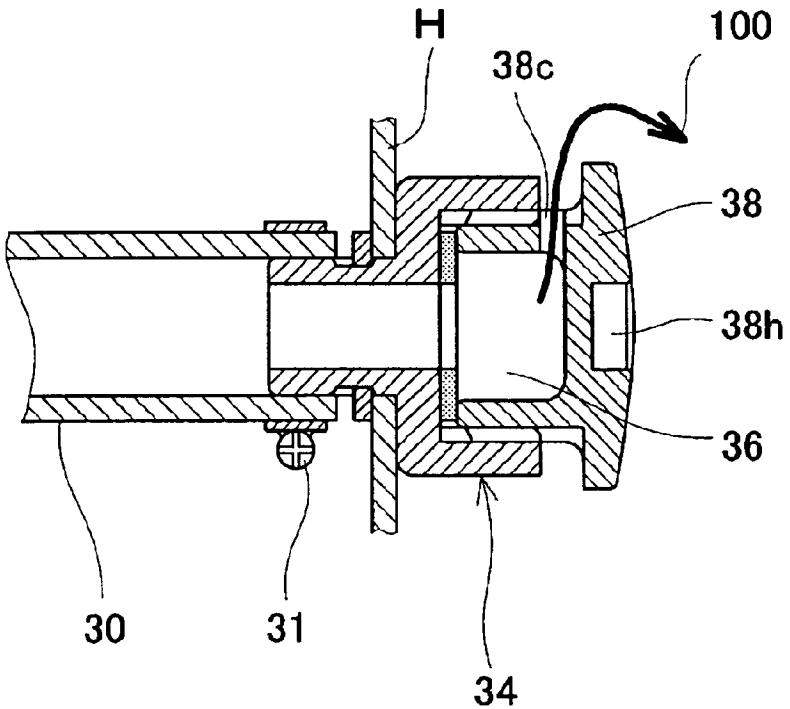
FIG. 9 is a partially enlarged cross-sectional view showing another structure of the first coupling member of the liquid connecting coupler which is mounted to the hull.
Figure 10:
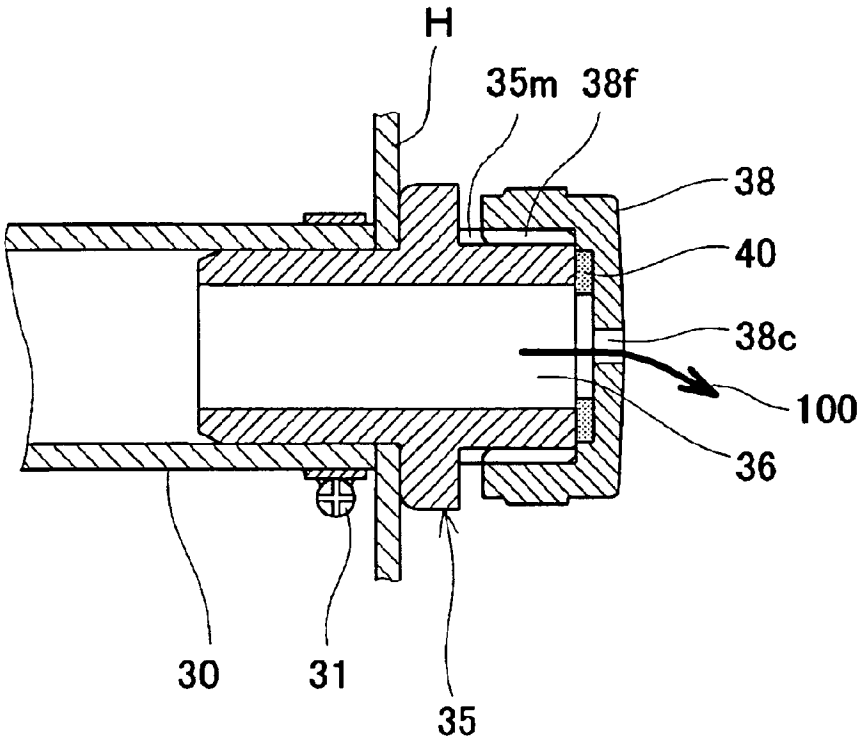
FIG. 10 is a partially enlarged cross-sectional view showing another structure of the first coupling member of the liquid connecting coupler which is mounted to the hull.

Alternatively, as shown in FIGS. 8 to 10, the lid member 38 may be provided with a water-inspection port 38*c*, and the conventional water inspection tube may be used as the tube 30.

While the personal watercraft is cruising on water, the rider can check whether or not the cooling water is being smoothly supplied to the engine E and the auxiliary device from the water being discharged outside from the water inspection port 38*c* as represented by a bold arrow 100. After the watercraft is beached, cleaning is carried out by removing the lid member 38 that closes the first coupling member 34. Such a construction is very advantageous, because a compact and lightweight personal watercraft is gained. When the lid member 38 is used to check the water as described above, it is preferable that the first coupling member 34 is located on a part of a vertically extending face of the hull H which is higher than the waterline and the opening 36 of the first coupling member 34 is directed laterally for the rider to easily check the water visually. In FIGS. 8 to 10, the same reference numerals as those in FIG. 5 denote the same or corresponding parts.

Alternatively, as shown in FIG. 10, the second coupling member 35 (see FIG. 7) forming a part of the liquid connecting coupler 32 is mounted to the hull H of the personal watercraft in FIG. 10. In this structure, the first coupling member 34 (see FIG. 5) is attached to the tip end of the hose 50 outside the body A, and the tube 30 inside the body A is attached to the second coupling member 35. A mounting structure of the lid member 38 to the second coupling member 35 is, as shown in FIG. 10, such that a female screw 38*f* is formed on an inner peripheral face of the lid member 38 having a bottom face so as to correspond to the male screw 35*m* formed on the outer peripheral face of the second coupling member 35. In this structure, the packing 40 may be provided between an upper end face of the second coupling member 35 and the bottom face of the lid member 38.

Such a structure is simple and makes the outer diameter of the lid member 38 larger, which makes it possible to easily open and close the opening 36 of the second coupling member 35. In FIG. 10, reference numeral 30 denotes a tube (water inspection tube) connected to the cooling water passage of the engine E and reference numeral 31 denotes a fixing member with which the tube 30 is fixed to the second coupling member 35.

Figure 3:
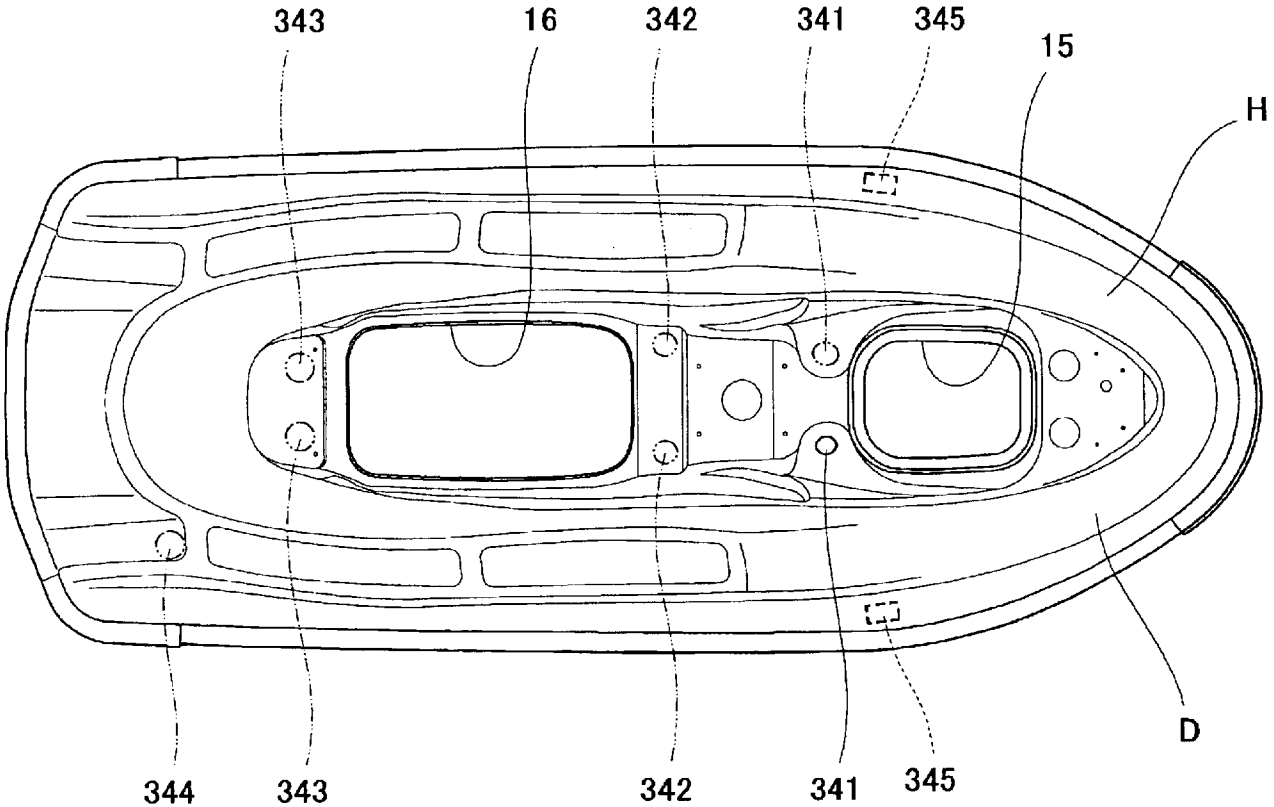
FIG. 3 is a plan view of a body of the personal watercraft, showing a position where a liquid connecting coupler is provided.

As shown in FIG. 3, the first coupling member 34 is provided on the body A at a position (341) on the deck D which is exposed by opening the front hatch cover 23 (see FIGS. 1 and 2), a position (342) within a tool box which is exposed by removing a cover 14 in the vicinity of console forward of the seat S, a position (343) exposed by removing a rear seat S2 of the seat S, or a position (344) on a rear deck 22. When the water inspection port 38*c* is provided on the lid member 38 to allow the rider to check the water as in the structures shown in FIGS. 8 to 10, the coupling member 34 (coupling member 35 in the structure in FIG. 10) is provided at a position to allow the rider straddling the seat S to visually check the water being discharged; for example, a position (345) in FIG. 3 which is on the vertically extending face of the hull H in a front-half portion of the body A and higher than the waterline. It should be appreciated that, the first coupling member 34 (or 35) is provided on the body A forward of the rider in a standing or kneeing position, in the case of a stand-up type personal watercraft.

In the structures described above, the first and second coupling members 34 and 35 may be made of various materials, for example, plastics, metals, or ceramics. For example, in this embodiment, the base part 34B is made of EPDM (ethylene, propylene, diene monomer). The EPDM is environmentally friendly and improves reliability of the first and second coupling members 34 and 35.

As shown in FIG. 4, an exhaust manifold 134 is connected to exhaust ports located on the right side of the engine E and water-cooled mufflers 120 and 121 are placed downstream of the exhaust manifold 134 in the flow passage of the exhaust gas so as to be spaced apart from each other in the lateral direction. The exhaust manifold 134 and the muffler 120 are respectively provided with cooling water passages. An air-intake manifold 133 is provided on the left side of the engine E. Fresh air is supplied from an air-intake box 135 provided behind and adjacent the engine E. A throttle body 136 is provided between the air-intake manifold 133 and the air-intake box 135.

An oil tank 137 is provided at a rear end portion of the engine E on the right side to reserve oil collected from a crankcase of the engine E. The oil tank 137 is also provided with a cooling water passage therein through which the cooling water flows to forcibly cool the oil. A battery 122 is provided at a position behind the air-intake box 135 on the left side. A breather box 138 is provided at a front end portion of the engine E on the right side. The breather box 138 serves to separate oil from a blow-by gas remaining within the crankcase. The gas is sent to the cylinder head 50 above the engine E and the oil is returned toward the crankcase.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft including an engine mounted within a body defined by a hull and a deck covering the hull from above, the watercraft being configured to cool at least part of the engine and an auxiliary device using water from outside the watercraft, comprising:

a cooling water passage provided in the part of the engine and the auxiliary device, the water from outside the watercraft being supplied to the cooling water passage;

a coupling member forming a part of a liquid connecting coupler and provided to fluidically communicate with the cooling water passage, the coupling member having a connecting portion to which another coupling member forming another part of the liquid connecting coupler is removably attachable, and the coupling member being fixed such that the connecting portion is exposed outside the body; and a lid member configured to open and close the connecting portion of the coupling member.

2. The personal watercraft according to claim 1, wherein the cooling water passage is fluidically connected to the coupling member through a tube.

3. The personal watercraft according to claim 2, wherein the tube is a water inspection tube used to detect the cooling water of the engine and the lid member is provided with a water inspection port through which the cooling water is discharged outside.

4. The personal watercraft according to claim 1, wherein the connecting portion has an opening directed outside and fluidically communicates with the cooling water passage, and the lid member is configured to openably close the connecting portion of the coupling member by screwing a male screw formed on an outer peripheral face of the lid member to a female screw formed on an inner peripheral face of the connecting portion.

5. The personal watercraft according to claim 4, wherein an outer peripheral edge of a flange portion of the lid member is configured to protrude radially outward relative to an outer peripheral edge of an opening end portion of the coupling member and the protruding outer peripheral edge has a convex and concave face for providing a non-slip surface.

6. The personal watercraft according to claim 1, wherein the coupling member is provided so as to be covered by an openable cover.

7. The personal watercraft according to claim 1, wherein the lid member is provided with a water inspection port through which the cooling water is discharged outside.

8. The personal watercraft according to claim 7, wherein the water inspection port is provided forward of a seat straddled by a rider or a standing deck on the watercraft.

9. The personal watercraft according to claim 2, wherein the coupling member includes:

an insertion part having a flange portion at an end portion thereof and an insertion portion extending from the flange portion and connected to the tube; and a cylindrical base part having a bottom portion, the base part including a penetrating hole formed at a center portion of the bottom portion thereof, through which the insertion portion is inserted, the bottom portion provided in an outer peripheral region of the penetrating hole being engageable with the flange portion such that the flange portion of the insertion part and the bottom portion of the cylindrical base part are rotatable relative to each other, the flange portion and the bottom portion being arranged in a longitudinal direction of the coupling member, and a female screw formed on an inner peripheral face of the cylindrical base part.

* * * * *